United States Patent [19]

Farrar et al.

[11] Patent Number: 4,514,922

[45] Date of Patent: May 7, 1985

[54] GUN MAGAZINE STRUCTURE

[75] Inventors: Frank W. Farrar, Los Alamitos; Carl J. Cupp, Hawaiian Gardens, both of Calif.

[73] Assignee: Pachmayr Gun Works, Inc., Los Angeles, Calif.

[21] Appl. No.: 462,958

[22] Filed: Feb. 1, 1983

[51] Int. Cl.[3] ..... F41C 25/02

[52] U.S. Cl. ..... 42/50; 42/7

[58] Field of Search ..... 42/50, 7

[56] References Cited

U.S. PATENT DOCUMENTS

| | | | |
|---|---|---|---|
| 2,620,582 | 12/1952 | Stukas | 42/50 |
| 3,143,819 | 8/1964 | Stevens, Jr. | 42/50 |
| 3,383,790 | 5/1968 | Into | 42/50 |
| 4,107,862 | 8/1978 | Sofinowski | 42/50 |
| 4,139,959 | 2/1979 | Howard et al. | 42/50 |
| 4,329,802 | 5/1982 | Coonan | 42/50 |
| 4,397,109 | 8/1983 | Pachmayr et al. | 42/50 |

OTHER PUBLICATIONS

Hoffschmidt, E. J., "Know Your Walther PP & PPK Pistols" pp. 24–27, 68, and 69.

*The American Rifleman*; Sep. 1956, p. 89.

*The American Rifleman*; Feb. 1957, p. 56.

*The American Rifleman*; Feb. 1960, p. 17.

*Primary Examiner*—Charles T. Jordan

*Attorney, Agent, or Firm*—William P. Green

[57] ABSTRACT

A gun magazine including a magazine body for holding a series of rounds of ammunition, and a floor plate at the lower end of the magazine body detachable therefrom by generally horizontal sliding movement relative to the body, with the floor plate preferably containing a recess extending downwardly into the floor plate beneath the lower extremity of the magazine body and into which the main ammunition follower spring projects downwardly. The floor plate may be connected to the magazine body loosely, in a manner enabling slight upward and downward shifting movement of the plate relative to body, and be provided with locking means for blocking lateral separation of the floor plate from the magazine body but adapted to be released to permit such separation by a slight shifting movement of the floor plate against the tendency of the main follower spring. The follower itself which is urged upwardly by that spring, to advance the ammunition upwardly, is releasably retained in a lower position by a spring pressed latching element to facilitate loading of rounds into the magazine.

11 Claims, 11 Drawing Figures

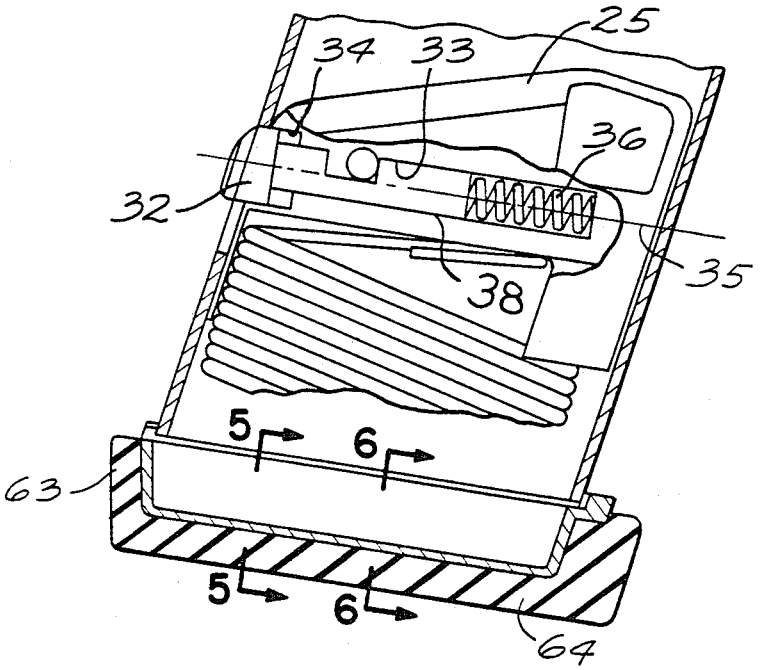
FIG. 4
FIG. 5
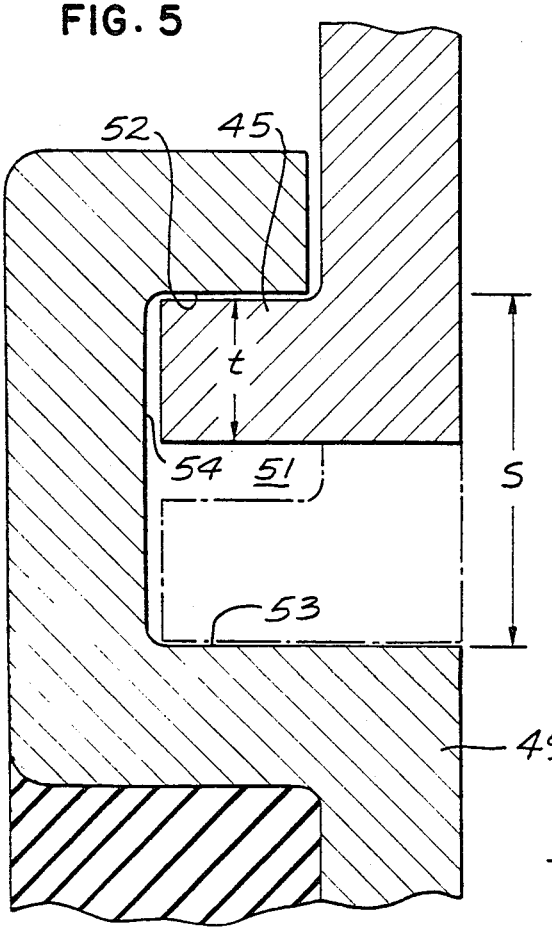
FIG. 6
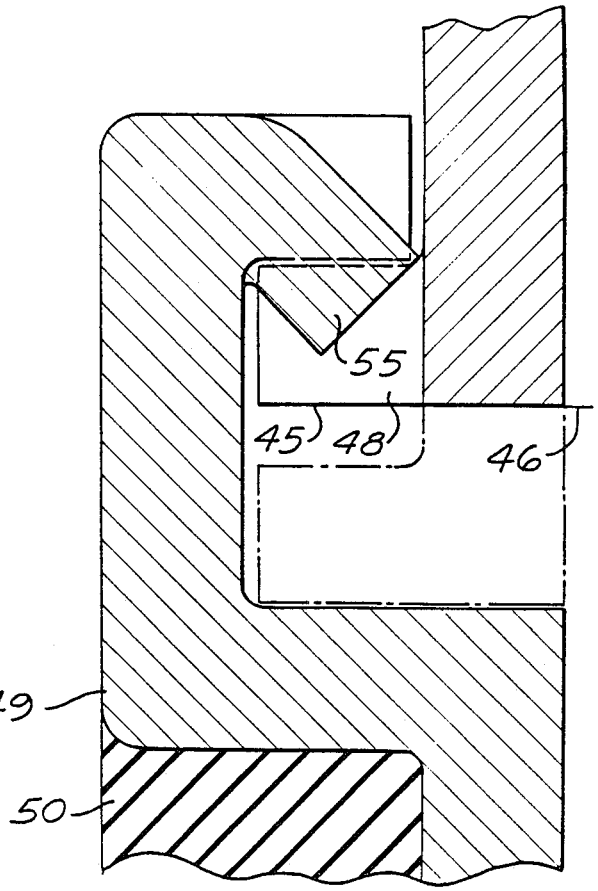

GUN MAGAZINE STRUCTURE

BACKGROUND OF THE INVENTION

This invention relates to improved magazines for holding ammunition in an automatic gun.

A magazine embodying the invention is of a known general type including an essentially vertically extending hollow magazine body within which a series of rounds of ammunition are contained to be forced successively upwardly for firing by the gun. A spring contained in the magazine body beneath the rounds urges the rounds upwardly toward the firing position, and applies this upward force through a follower which is movable vertically within the magazine body and engages the lowermost round. The follower may be manually held downwardly in a lower position during loading of the rounds into the upper end of the magazine body. The lower end of the magazine body is closed by a floor plate or bottom wall, which in some instances is slidably connected to the magazine for horizontal detachment therefrom, and may be releasably retained against detachment by a holding part urged by the main follower spring of the magazine against the floor plate and interfitting therewith to releasably retain the floor plate against sliding withdrawal.

SUMMARY OF THE INVENTION

One purpose of the present invention is to provide a unique latching arrangement for releasably holding the ammunition follower in a magazine of the above discussed type in its lower loading position, so that a user can easily insert a desired number of rounds into the upper end of the magazine without being required to manually maintain the follower in its lower position against the tendency of the follower spring during the entire loading operation. As soon as the loading has been completed, a user can then easily release the latch mechanism to permit the follower and spring to again exert upward force on the ammunition for feeding it automatically to firing position in a gun. The latch element is yieldingly urged toward an active position to automatically attain a holding condition upon arrival of the follower at its desired lower position, and is then releasable by manual inward depression of the latching element against the tendency of its spring or other yielding means to permit upward movement of the follower. It is understood that a prior art type of magazine has included a pin which perhaps could be manipulated in a manner holding the associated follower in a lower loading position. However, the pin in that magazine was intended to be used merely for manually pulling the follower downwardly, and not for latching it in a lower position, and does not serve this latter function as effectively and conveniently as the present holding device.

An additional feature of the invention relates to a preferred manner of forming the floor plate of the magazine to maximize the effective internal length of the magazine and thus the number of shells which can be contained therein without requiring projection of the magazine downwardly beyond the normal position of the lower extremity of a standard type magazine having a pad. This enables use of a special follower having the above discussed latching mechanism and occupying a greater portion of the vertical length of the magazine than does the conventional follower without at the same time reducing the number of shells receivable in the magazine. Alternatively, the novel floor plate structure can be employed with a conventional follower rather than the latchable device of the present invention, and in that event will allow reception in the standard length magazine of one more round than can normally be held.

To attain these purposes, the floor plate is formed to contain a recess which extends downwardly into the floor plate to a level beneath that of the sliding connection between the floor plate and the lower end of the magazine body. The follower spring can then extend downwardly into that recess in a manner permitting the spring in its completely compressed condition to project somewhat lower than in the usual magazine, thereby allowing for reception of an added round or a follower of increased vertical extent in the magazine as discussed. The recessed floor plate can be covered about its exterior with elastomeric material giving the external appearance of a solid bottom cushion of a type currently popular.

The invention further provides a unique locking mechanism for releasably retaining a floor plate against sliding detachment generally horizontally from the lower end of a magazine body. This locking mechanism may be releasable by slight generally vertical displacement of the floor plate relative to the bottom portion of the magazine body, acting to shift blocking shoulders of the floor plate and body to relative positions in which they no longer prevent but permit lateral sliding movement of the floor plate from the magazine body.

BRIEF DESCRIPTION OF THE DRAWINGS

The above and other features and objects of the invention will be better understood from the following detailed description of the typical embodiments illustrated in the accompanying drawings in which:

FIG. 4 is a vertical section taken on line 4—4 of FIG. 3;

FIGS. 5 and 6 are further enlarged fragmentary transverse vertical sections taken on lines 5—5 and 6—6 respectively of FIG. 4;

DESCRIPTION OF THE PREFERRED EMBODIMENTS

Figure 1:
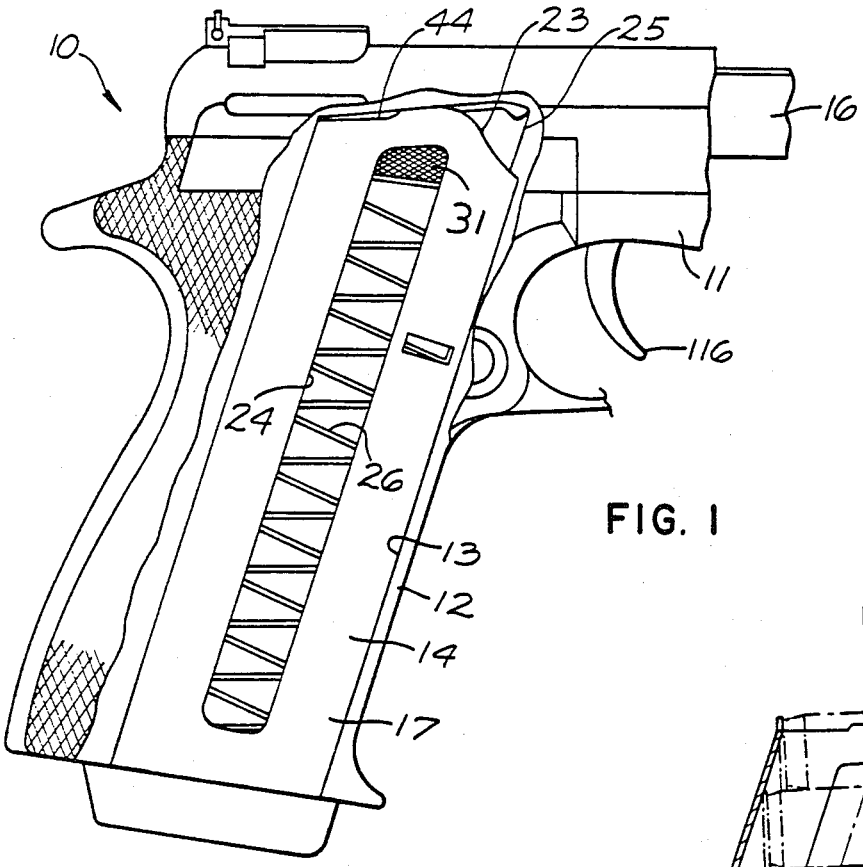
FIG. 1 is a side view of an ammunition magazine for an automatic gun, typically a pistol of the Colt type, with the magazine illustrated as it appears when inserted into the handle of the gun.

In FIG. 1, there is represented fragmentarily at 10 an automatic pistol of the Colt type, having a main body or frame 11 with a handle portion 12 within which an upwardly and forwardly inclined guideway 13 is formed to receive a magazine 14 adapted to be inserted into the guideway from its open lower end. When the gun is loaded, a series of cartridges or rounds 15 (FIG. 2) are contained within magazine 14 and are automatically and successively fed upwardly from the magazine to the automatic loading mechanism which delivers individual cartridges to the firing chamber and the rear end of barrel 16 for firing through the barrel upon manual actuation of a trigger 116.

Figure 8:
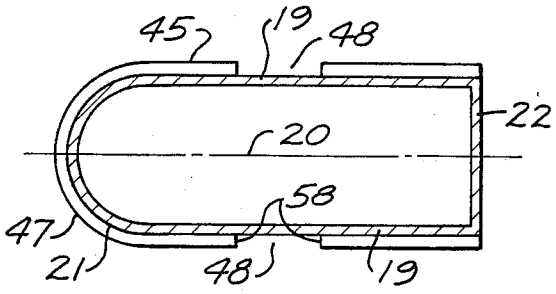
FIG. 8 is a horizontal section taken on line 8—8 of FIG. 7.

Magazine 14 includes a hollow generally vertically extending essentially tubular magazine body 17, extending along an axis 18 which is normally inclined at an angle a with respect to the true vertical when the gun is in position to be fired horizontally. As seen in FIG. 8, the magazine body has two parallel vertical opposite side walls 19 disposed parallel to and spaced equal distances from the main vertical central plane 20 of the gun and magazine. These side walls are joined by a rounded front wall 21 of the magazine body, and a rear transverse wall 22. This essentially tubular generally vertical magazine structure may be stamped from a single piece of sheet metal as shown, or be formed sectionally from two or more parts welded together. An opening 23 at the top of the magazine body and of conventional configuration allows the uppermost shell to be fed forwardly from the magazine to the firing chamber by the action of the gun. Two elongated slots 24 are formed in the opposite side walls 19 of the magazine body.

Within magazine body 17, there is contained a follower 25 which engages the lowermost round 15 in the magazine and yieldingly urges it and the other rounds upwardly for successive firing. This follower 25 is in turn urged upwardly by a coil spring 26, dimensioned to occupy the major portion of the horizontal extent of the interior of the magazine body, with an upper end 27 of the spring bearing against the follower 25, and a lower end 28 of the spring bearing downwardly against a floor plate 29 which will be described in greater detail at a later point.

Figure 10:
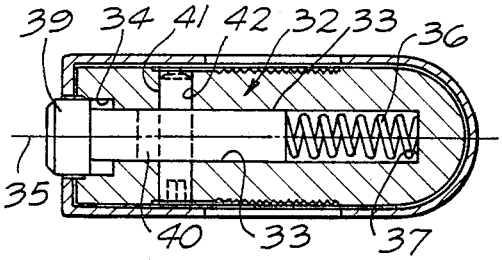
FIG. 10 is a generally horizontal section taken on line 10—10 of FIG. 2.

As seen in FIG. 10, the follower 25 has a cross-sectional configuration transversely of the longitudinal axis 18 of the magazine which corresponds essentially to and is a fairly close fit within the inner upwardly inclined ammunition feeding chamber 30 within body 17. As a result of this close fit within the magazine body, follower 25 is effectively guided for movement relative to and within the magazine body along its axis 18, and is retained in a predetermined orientation relative to the magazine body as the carrier moves between its lowermost position of FIG. 2 and its uppermost position of FIG. 1. At its opposite sides, follower 25 has portions 31 which are exposed to be contacted by a user's fingers through slots 24, and which may be checkered or otherwise irregularized to enable a user to forcibly manually displace the follower 25 downwardly from its FIG. 1 position to its FIG. 2 position against the tendency of spring 26.

Figure 2:
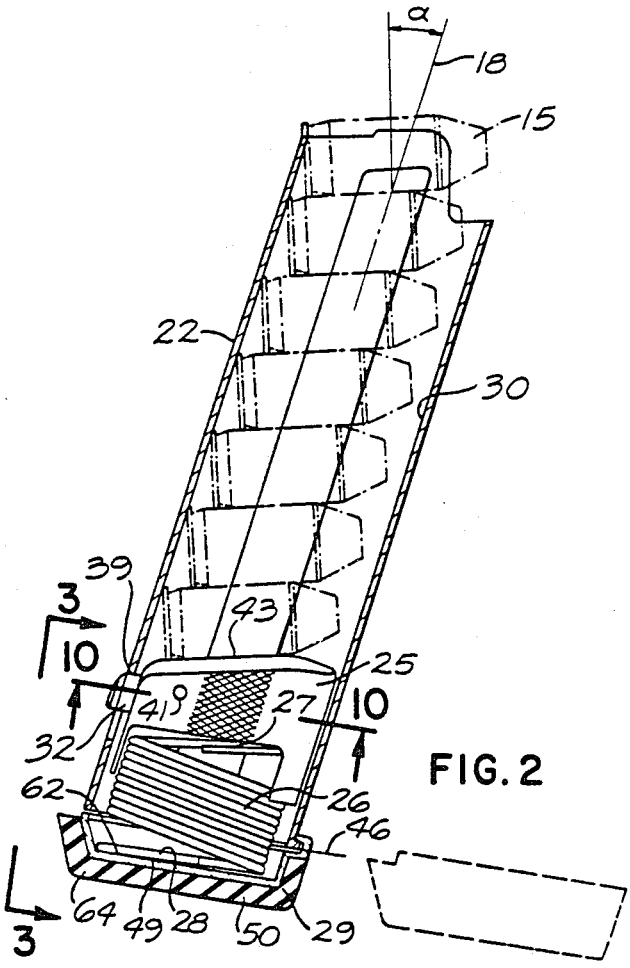
FIG. 2 is a vertical section through the magazine of FIG. 1, taken primarily in the central vertical front to rear plane of the gun and magazine.
Figure 3:
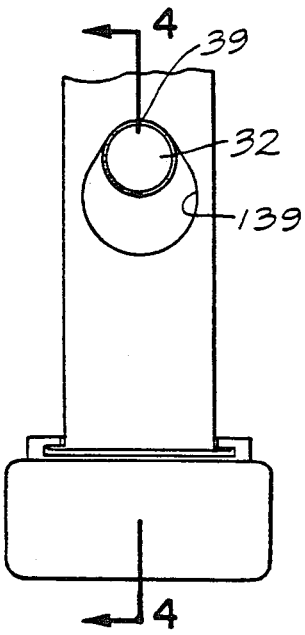
FIG. 3 is an enlarged fragmentary rear view taken on line 3—3 of FIG. 2.

The follower is adapted to be automatically and releasably retained in its FIG. 2 position by a latch pin 32 which is mounted within a bore 33 and counterbore 34 in follower 25 for movement along the axis 35 of that bore from the inactive or released position of FIG. 1 to the active latching position of FIG. 2 under the influence of a spring 36 contained within the bore and bearing against an end wall 37 thereof. The latch pin 32 may have an externally cylindrical shank 38 within bore 33 and an enlarged diameter cylindrical head 39 within counterbore 34, with the shank containing a recess or notch 40 within which a stop pin 41 carried by follower 25 is received in a relation limiting axial movement of latch element 32, and in particular limiting the outward movement of the latch element under the influence of spring 36 in the position of FIG. 2. In that condition, the outer cylindrical surface of head 39 of latch element 32 engages upwardly against the material of the magazine body at the top of an opening 139 in rear wall 22 of the body, in a relation positively blocking upward movement of the latch element 32 and the attached follower 25. As seen in FIG. 10, the stop pin 41 has its opposite ends received within a passage 42 in the body of follower 25, and may be a tight pressed fit within passage 42 to frictionally retain pin 41 in its illustrated assembled position functioning as a stop for latching element 32.

The upper surface 43 of the ammunition follower may be somewhat rounded as shown and disposed generally parallel to the axis of the barrel of the gun to locate the round in a desired horizontally extending condition for delivery to the firing chamber of the gun. Also, the upper end portion of the magazine body 17 should have its opposite side edges turned laterally inwardly at 44 in conventional manner to limit upward movement of the rounds, and of the follower in the FIG. 1 position.

Floor plate 29 is connected to the lower end of the magazine body for horizontal sliding movement relative thereto between the full line and broken line positions of FIG. 2, to detach the floor plate from the magazine body and allow downward removal of the spring 26 and follower 25 from the lower end of the magazine when necessary for repair or replacement. To mount the floor plate for such horizontal sliding movement, the lower end of magazine body 17 is shaped to have a peripheral flange 45 (FIG. 8) which extends laterally outwardly from the lower end of the magazine body in a generally horizontal plane 46 (FIGS. 2 and 6). This flange 45 extends along the opposite sides of the magazine body and along its forward rounded end at 47, but may be interrupted at the location of the previously mentioned rear transverse wall 22 of the magazine body. The opposite side portions of flange 45 are also interrupted to form two notches 48 at the sides of the magazine.

Floor plate 29 is preferably formed of two parts, including a rigid strengthening or reinforcing element 49 typically stamped of steel or other sheet metal and a body of rubber or other resiliently deformable elastomeric material 50 extending about the outer surfaces of and cushioning element 49. At its upper edge, part 49 is shaped to define a horizontally extending groove 51 for slidably receiving flange 45 of the magazine body to guide the floor plate for horizontal sliding movement into and out of connected relation with respect to the lower end of the magazine body. More particularly, this groove may be defined by upper and lower horizontally extending walls 52 and 53 of the groove joined by a vertically extending wall 54. The vertical spacing s (FIG. 5) between upper and lower walls 52 and 53 of the groove is greater than the vertical thickness t of flange 45 of the magazine body, to enable slight relative vertical movement of the floor plate and magazine body in the manner shifting flange 45 between the full line and broken line positions of FIGS. 5 and 6. Spring 26 normally yieldingly urges the floor plate downwardly relative to the magazine body to a condition in which the flange and groove are in the relationship illustrated in full lines in FIGS. 5 and 6. When the floor plate is to be removed, it can be pressed upwardly relative to the magazine, causing shifting movement of the flange 45 to its broken line position of FIGS. 5 and 6 in the lower portion of the groove.

Figure 7:
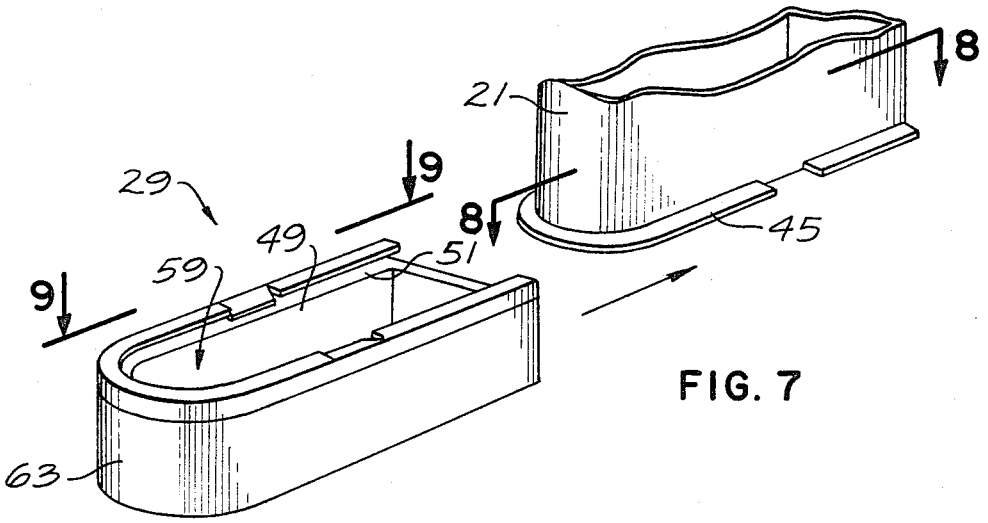
FIG. 7 is a fragmentary representation of a floor plate and the lower portion of the magazine body.
Figure 9:
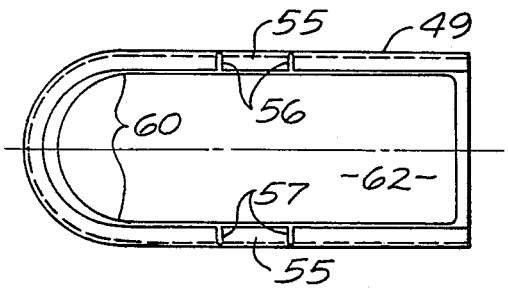
FIG. 9 is a plan view representation of the floor plate, taken on line 9—9 of FIG. 7.

This manual displacement of the floor plate relative to the magazine body frees the floor plate for sliding detachment from the magazine body. For this purpose, the top wall 52 of groove 51 in the floor plate element 49 has two portions 55 which are separated from the remainder of wall 52 by slits 56 (FIG. 9), and which are then bent slightly downwardly at an inclination as illustrated in FIGS. 6 and 7 for reception within the notches 48 formed in the side portions of magazine body flange 45 in the assembled condition of the parts as illustrated in full lines in FIGS. 5 and 6. These downturned tabs 55 have an extent in a left to right direction as viewed in FIG. 9 just slightly less than the corresponding dimension of notches 48 in the magazine body flange 45, so that the front and rear edges 57 of the tabs disposed transversely of front to rear plane 20 of the magazine can abut against the edges 58 formed by flange 45 at the front and rear of its notches 48 to prevent sliding movement of the floor plate relative to the magazine body. When the floor plate is pressed upwardly against the tendency of spring 26, flange 45 is received entirely beneath the level of tabs 45 as represented in broken lines in FIG. 6, and thus the shoulders 57 and 58 on the tabs and flange 45 are not engageable with one another to prevent detachment of the floor plate, but rather can pass one another as the floor plate is manually slid horizontally from the magazine body.

Beneath the level of the sliding connection formed by flange 45 and walls 52 and 53 forming groove 51, element 49 is shaped to form and contain a recess 59 into which magazine spring 26 projects downwardly a substantial distance beyond the level of the sliding connection. This recess 59 is defined by walls 60 extending vertically along opposite sides and the rear of recess 59 and generally vertically at the front of the recess and a generally horizontal bottom wall 62 against which the spring bears downwardly. The elastomeric material 50 about the outside of this element 62 has similar vertical or generally vertical portions 63 extending entirely about the opposite sides, rear and front of the walls 60 of rigid inner element 49 and merging with a lower portion 64 of the elastomeric material covering the underside of bottom wall 59 of element 49. The outer surfaces of this elastomeric material are resiliently deformable when contacted by a user's hand in a manner cushioning such contact and enabling a user to push the magazine assembly 14 upwardly into a gun without discomfort.

To load the magazine of FIGS. 1 through 10, assuming the magazine assembly to initially be completely empty as illustrated in FIG. 1, a person may hold the magazine body in one hand and then grasp follower 25 between the thumb and index finger of the other hand, with the thumb and index finger extending through slots 24 at opposite sides of the magazine body and into engagement with the irregularized surfaces 31 of the follower. The user then pulls the follower downwardly within the magazine body from the FIG. 1 position to the FIG. 2 position, at which point latching pin or element 32 is forced laterally outwardly (rearwardly) by spring 36 through opening 139 in the magazine body to latch the follower in its lowermost position against the tendency of spring 26. In any position above that of FIG. 2, the latch element 32 is retained in a retracted position within follower 25 by engagement with the inner surface of back wall 22 of the magazine body. With the follower thus held in its lowermost position, a series of rounds 15 can be easily inserted in the upper end of the magazine body to the positions illustrated in FIG. 2, after which a user can press pin 32 forwardly out of its latching engagement with the edge of opening 139, freeing the follower for upward movement to press the rounds upwardly as far as they can move within the magazine body. The positioning of opening 139 is such that follower 25 will move upwardly a short distance above the FIG. 2 position when the latch element is released and when a predetermined number of rounds of ammunition constituting a full load are present in the magazine body, so that the magazine body then retains the latch element in its released condition.

The vertical extent of the follower 25 as illustrated is somewhat greater than the vertical extent of most conventional followers utilized in similar magazine assemblies because of the presence of the latching element 32 and related parts in the follower. In the absence of other compensation for this fact, the use of the follower 25 might reduce the number of rounds which could be contained within a standard length cartridge body. The provision of floor plate 32 containing recess 59 overcomes this disadvantage, since the recess permits the spring to project downwardly farther than other standard length magazine bodies, with the result that the spring in its fully compressed condition is somewhat lower than would otherwise be the case, thus permitting the follower to move downwardly far enough for reception in the standard length magazine body of the usual supply of seven rounds. If a more conventional follower is substituted for that illustrated in the figures, while still retaining the recessed floor plate, a standard size magazine body can contain eight rounds, that is, one more than is normally possible.

If it becomes desirable to disassemble the magazine structure, this may be accomplished very easily by merely pressing the floor plate slightly upwardly relative to the magazine body 17, thereby releasing the locking interengagement between the floor plate and magazine body as previously discussed, and enabling the floor plate to be horizontally slidably detached from the lower end of the magazine body. During such detachment, the follower 25 is normally in the uppermost position of FIG. 1, and the spring 26 can be compressed upwardly far enough to move it out of the recess in the floor plate and avoid interference by the spring with detachment of the floor plate.

Figure 11:
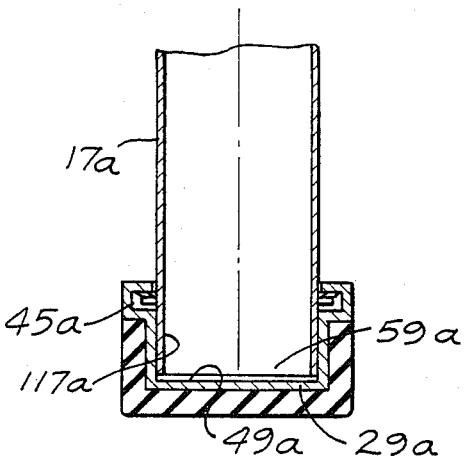
FIG. 11 is a vertical transverse section through a variational form of the invention, taken in a plane corresponding to that of FIG. 5.

FIG. 11 shows a variational arrangement which may be considered as identical with that of FIGS. 1 through 10 except that the magazine body **17*a* corresponding to body 17 of the first form of the invention projects downwardly at 117*a* beyond flange 45*a* of the magazine body corresponding to flange 45. This lower portion 117*a* may project down to the bottom of a recess 59*a* in the floor plate 29*a*. The sliding connection between flange 45*a* and the grooved upper portion of part 49*a* of the floor plate may be the same as that discussed in connection with the first form of the invention, with a freedom for slight upward movement of the floor plate relative to the magazine body in a manner releasing blocking elements such as tabs 55 of FIG. 6** from holding engagement with the flange and thereby freeing the floor plate for removal from the magazine body.

While certain specific embodiments of the present invention have been disclosed as typical, the invention is of course not limited to these particular forms, but rather is applicable broadly to all such variations as fall within the scope of the appended claims.

We claim:

1. A magazine comprising:

a magazine body to be removably inserted into a gun and adapted to contain a series of rounds of ammunition;

a spring yieldingly urging said rounds upwardly for firing by the gun;

a floor plate disposed across the bottom of said body;

a sliding connection mounting said floor plate to said body for generally horizontal sliding movement relative thereto to attach the floor plate to or remove it from said body;

said sliding connection being constructed to allow slight generally vertical movement of the floor plate relative to said body; and locking means for blocking sliding detachment of said floor plate from said magazine body and adapted to be released to permit such sliding detachment by said slight generally vertical movement of the floor plate relative to the magazine body.

2. A magazine as recited in claim 1, in which said spring yieldingly urges said floor plate downwardly relative to said magazine body, and said locking means are released to permit sliding detachment of the floor plate from the magazine body by slight upward movement of the floor plate relative to the magazine body against the tendency of said spring.

3. A magazine as recited in claim 1, in which said locking means include shoulders on said floor plate and body which are shiftable into and out of blocking relation by said slight vertical movement of the floor plate relative to said body.

4. A magazine as recited in claim 1, in which said sliding connection includes flange means carried by said magazine body projecting laterally therefrom and groove means formed in said floor plate and slidably receiving said flange means with a looseness enabling said slight vertical movement of the floor plate relative to the magazine body, said blocking means including an interruption formed in said flange means, and a shoulder structure carried by the floor plate and occupying a portion but not all of the vertical extent of said groove means and engageable within said interruption in a relation blocking sliding withdrawal of the floor plate from the magazine body when the floor plate is in a lower position thereof but not when the floor plate is in a slightly higher position enabling such detachment.

5. A magazine as recited in claim 1, in which said sliding connection includes a peripheral flange structure carried by said magazine body and projecting laterally from the lower extremity thereof and along two opposite sides of the magazine body and an end thereof, and a groove formed in said floor plate and slidably receiving said flange at said opposite sides and said end of the magazine body, said flange having two interruptions at said opposite sides of the magazine body, and said floor plate having portions projecting downwardly into said groove through part but not all of the vertical extent thereof and adapted to be received within said interruptions in said flange in a lower position of the floor plate to block sliding detachment of the floor plate from the magazine body, but being shiftable out of said interruptions to positions permitting sliding detachment of the floor plate from the magazine body by said slight upward shifting movement of the floor plate relative to the magazine body against the tendency of said spring.

6. A magazine comprising:

a magazine body to be removably inserted into a gun and adapted to contain a series of rounds of ammunition to be fed successively upwardly for firing by the gun;

a spring within said magazine body urging the rounds upwardly;

a floor plate extending across the bottom of said magazine body; and a sliding connection between said magazine body and said floor plate mounting said floor plate for generally horizontal sliding movement relative to the magazine body to attach the floor plate to and detach it from the body;

said floor plate containing a recess extending downwardly therein beneath the level of said sliding connection and into which a lower portion of said spring extends;

said floor plate including an essentially rigid element having side walls extending about said recess and a bottom wall extending across the bottom of the recess, and resiliently deformable elastomeric material extending about said side walls and across the underside of said bottom wall of said essentially rigid element;

said sliding connection including flanges projecting laterally outwardly from said magazine body and guideway grooves formed by upper portions of said essentially rigid element of the floor plate and slidably engaging said flanges;

said flanges having interruptions, and said floor plate having portions receivable within said interruptions in a relation releasably blocking sliding removal of said floor plate from said magazine body;

said sliding connection being constructed to allow slight upward and downward shifting movement of the floor plate relative to the magazine body;

said portions of the floor plate receivable within said interruptions in said flanges being shiftable out of said interruptions to positions allowing sliding removal of the floor plate from the magazine body by slight upward displacement of the floor plate relative to the magazine body against the tendency of said spring.

7. A magazine comprising:

a magazine body to be inserted into a gun and adapted to contain a series of rounds of ammunition;

a follower movable vertically within said magazine body beneath said rounds for urging them upwardly;

a spring yieldingly urging said follower upwardly in the magazine body;

a latch element mounted to said follower for upward and downward movement therewith and for movement laterally outwardly relative thereto in a lower position of the follower in which the upper portion of the magazine is accessible for loading of rounds thereinto;

means yieldingly urging said latch element laterally outwardly relative to said follower in said lower position of the follower;

said magazine having shoulder means engageable with said latch element in said lower position of the follower to lock the follower against upward movement from that position;

said latch element when in engagement with said shoulder means being exposed for manual inward deflection against the tendency of said yielding means and out of locking engagement with the shoulder means to permit upward movement of the follower by said spring;

said magazine having a generally vertically extending wall engageable with said latch element when the follower is above said lower position thereof and in a relation holding the latch element laterally inwardly;

said wall containing an opening through which said latch element is urged outwardly in said lower position of the follower with an edge of said opening forming said shoulder means;

said latch element being slidably mounted in said follower for longitudinal movement along an axis;

said yielding means comprising a spring inwardly of said latch element and urging it laterally outwardly; and a stop pin carried by said follower and received within a recess in said latch element to limit axial movement thereof.

8. A magazine comprising:

a magazine body to be inserted into a gun and adapted to contain a series of rounds of ammunition;

a follower movable vertically within said magazine body beneath said rounds for urging them upwardly;

a spring yieldingly urging said follower upwardly in the magazine body;

a latch element mounted to said follower for upward and downward movement therewith and for movement laterally outwardly relative thereto in a lower position of the follower in which the upper portion of the magazine is accessible for loading of rounds thereinto;

means yieldingly urging said latch element laterally outwardly relative to said follower in said lower position of the follower;

said magazine having shoulder means engageable with said latch element in said lower position of the follower to lock the follower against upward movement from that position;

said latch element when in engagement with said shoulder means being exposed for manual inward deflection against the tendency of said yielding means and out of locking engagement with the shoulder means to permit upward movement of the follower by said spring;

said latch element being slidably mounted in said follower for longitudinal movement along an axis;

said yielding means comprising a spring inwardly of said latch element and urging it laterally outwardly; and a stop pin carried by said follower and received within a recess in said latch element to limit axial movement thereof.

9. A magazine comprising:

a magazine body to be removably inserted into a gun and adapted to contain a series of rounds of ammunition to be fed successively upwardly for firing by the gun;

a spring within said magazine body urging the rounds upwardly;

a floor plate extending across the bottom of said magazine body and containing a recess extending downwardly into the floor plate;

said floor plate including an essentially rigid element having a bottom wall extending across the bottom of the recess and having side walls projecting upwardly from said bottom wall about said recess, and including resiliently deformable elastomeric material with a lower portion extending across the underside of said bottom wall of said essentially rigid element and side portions extending upwardly about said side walls of said essentially rigid element and above the level of said bottom wall thereof;

said magazine body and said side walls of said essentially rigid element of the floor plate having slidably interfitting portions which are located near upper edges of said side walls and at a level above said bottom wall and which engage one another at that level in a relation mounting said floor plate for generally horizontal sliding movement relative to the magazine body to attach the floor plate to and detach it from the body;

said spring having a lower portion projecting downwardly past said slidably interfitting portions of said magazine body and essentially rigid element and into said recess to a location within said side walls of said essentially rigid element and within said side portions of said elastomeric material.

10. A magazine as recited in claim 9, in which said interfitting portions of said magazine body and essentially rigid element include flanges near the lower extremity of said magazine body projecting generally horizontally in opposite directions therefrom, and upper edge portions of said essentially rigid element of the floor plate containing grooves within which said flanges are slidably received to connect the floor plate to the body for said relative horizontal movement.

11. A magazine body as recited in claim 9, in which said slidably interfitting portions of said magazine body and said side walls of said essentially rigid element are constructed to allow slight upward and downward shifting movement of the floor plate relative to the magazine body, there being locking means for blocking sliding detachment of said floor plate from said magazine body and adapted to be released to permit such sliding detachment by said slight generally vertical movement of the floor plate relative to the magazine body.

* * * * *